US009176422B2

(12) United States Patent
Murata

(10) Patent No.: US 9,176,422 B2
(45) Date of Patent: Nov. 3, 2015

(54) DEVELOPER COLLECTING DEVICE AND IMAGE FORMING APPARATUS

(71) Applicant: FUJI XEROX CO., LTD., Tokyo (JP)

(72) Inventor: Shigemi Murata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/134,594

(22) Filed: Dec. 19, 2013

(65) Prior Publication Data

US 2014/0301746 A1 Oct. 9, 2014

(30) Foreign Application Priority Data

Apr. 3, 2013 (JP) ..... 2013-077528

(51) Int. Cl.
*G03G 15/08* (2006.01)

(52) U.S. Cl.
CPC ..... *G03G 15/0879* (2013.01)

(58) Field of Classification Search
CPC ..... G03G 21/10; G03G 21/105; G03G 21/12
USPC ..... 399/33
See application file for complete search history.

(56) References Cited

U.S. PATENT DOCUMENTS 4,260,073 A * 4/1981 Baumann ..... 222/1
4,894,688 A * 1/1990 Taniguchi et al. ..... 399/359
7,885,565 B2 * 2/2011 Sasaki et al. ..... 399/57
2009/0245832 A1 * 10/2009 Aoki et al. ..... 399/53
2010/0080578 A1 * 4/2010 Ichikawa ..... 399/34
2010/0080637 A1 * 4/2010 Yamaguchi et al. ..... 399/358
2011/0097124 A1 * 4/2011 Koike et al. ..... 399/358
2011/0236074 A1 9/2011 Maeda et al.
2013/0251433 A1 * 9/2013 Toshiyuki ..... 399/358
2014/0010559 A1 * 1/2014 Furukawa ..... 399/34

FOREIGN PATENT DOCUMENTS

JP A-2011-203330 10/2011

* cited by examiner

*Primary Examiner* — Clayton E Laballe
*Assistant Examiner* — Ruifeng Pu
(74) *Attorney, Agent, or Firm* — Oliff PLC

(57) ABSTRACT

A developer collecting device includes a collecting box that accommodates developer discharged from a developing unit, the developing unit accommodating developer including toner and a carrier, the developing unit developing an electrostatic latent image on a development member using the toner in the developer; a guide cylinder that connects the developing unit and the collecting box to each other, the guide cylinder guiding movement of the developer discharged from the developing unit to the collecting box; a transporting member that is disposed in the guide cylinder and extends in a developer transport direction, the transporting member transporting the developer towards the collecting box by rotation of the transporting member; and a rotation controller that controls rotation speed of the transporting member in accordance with conditions that affect a capability of developing the electrostatic latent image on the development member.

8 Claims, 7 Drawing Sheets

DEVELOPER COLLECTING DEVICE AND IMAGE FORMING APPARATUS

CROSS-REFERENCE TO RELATED APPLICATIONS

This application is based on and claims priority under 35 USC 119 from Japanese Patent Application No. 2013-077528 filed Apr. 3, 2013.

BACKGROUND

1. Technical Field

The present invention relates to a developer collecting device and an image forming apparatus.

2. Summary

According to an aspect of the invention, there is provided a developer collecting device including a collecting box that accommodates developer discharged from a developing unit, the developing unit accommodating developer including toner and a carrier, the developing unit developing an electrostatic latent image on a development member using the toner in the developer; a guide cylinder that connects the developing unit and the collecting box to each other, the guide cylinder guiding movement of the developer discharged from the developing unit to the collecting box; a transporting member that is disposed in the guide cylinder and extends in a developer transport direction, the transporting member transporting the developer towards the collecting box by rotation of the transporting member; and a rotation controller that controls rotation speed of the transporting member in accordance with conditions that affect a capability of developing the electrostatic latent image on the development member by the developing unit.

BRIEF DESCRIPTION OF THE DRAWINGS

An exemplary embodiment of the present invention will be described in detail based on the following figures, wherein.

DETAILED DESCRIPTION

An exemplary embodiment of the present invention is hereunder described.

Figure 1:
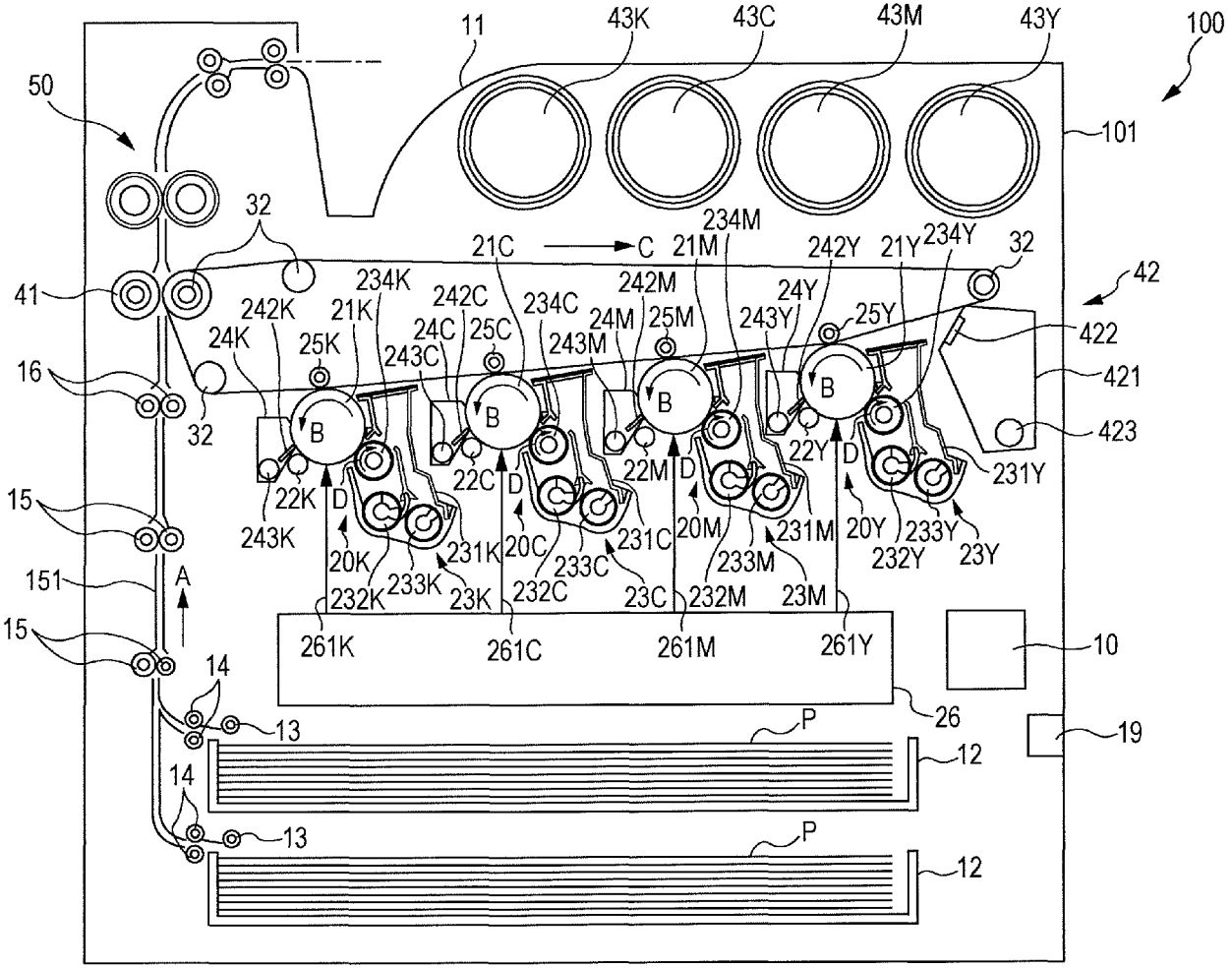
FIG. 1 is a schematic view of a structure of a printer serving as an exemplary image forming apparatus.

FIG. 1 is a schematic view of a structure of a printer 100 serving as an exemplary image forming apparatus.

The printer 100 is enclosed by a frame 101 and includes a controller 10 within the frame 101. The controller 10 controls the entire printer 100. Image data is input to the controller 10 from outside the printer 100, such as an image processing computer or a scanner that reads document image and that generates the image data. In the controller 10, the image data that is input from outside the printer 100 is converted into exposure light generation image data that is output from an exposure unit 26 (described later).

A temperature-and-humidity sensor 19 that measures the temperature and humidity of an internal environment of the printer 100 is provided within the frame 101 of the printer 100.

In this printer 100, a sheet-discharge table 11 onto which is discharged a sheet on which an image has been formed is provided at an upper portion of the frame 101. Two sheet-feed trays 12 that are provided one above the other are disposed at a lower portion of the printer 100. Sheets P that do not have images formed thereon are accommodated in a stacked state in the sheet-feed trays 12. The sheet-feed trays 12 are capable of being drawn out for replenishing the sheet-feed trays 12 with sheets P.

In forming images, sheets P are sent out from one of the sheet-feed trays 12 by a pickup roller 13, and are separated one by one by flip-through rollers 14. One of the sheets P is transported upward by transport rollers 15 along a transport path 151 in the direction of arrow A. Thereafter, standby rollers 16 adjust timing of subsequent transport, so that the sheet P is transported further upward. The transport of the sheet after the sheet has passed a location between the standby rollers 16 is described below.

Four image formation engines, that is, an image formation engine 20Y, an image formation engine 20M, an image formation engine 200, and an image formation engine 20K are disposed at substantially the center of the printer 100 in an up-down direction. These image formation engines 20Y, 20M, 20C, and 20K are devices for forming toner images using yellow (Y) toner, magenta (M) toner, cyan (C) toner, and black toner (K). The image formation engines 20Y, 20M, 20C, and 20K have the same structure.

When descriptions of the image formation engines 20Y, 20M, 20C, and 20K that are common to each other are hereunder given, the image formation engines are indicated as image formation engines 20 without using the letters Y, M, C, and K in their symbols. This also applies to the other structural components.

Each image formation engine 20 includes a photoconductor member 21 that rotates in the direction of arrow B in FIG. 1, with a charging unit 22, a developing unit 23, and a cleaner 24 being disposed around the photoconductor member 21.

Each transfer unit 25 is disposed opposite its corresponding photoconductor member 21 with an intermediate transfer belt 31 (described later) being interposed therebetween.

Here, each photoconductor member 21 is a roller, and carries an electrostatic latent image on its surface by carrying an electric charge as a result of charging, and by emitting electricity as a result of exposure. Each photoconductor member 21 corresponds to an exemplary development member and an exemplary image carrying member.

Each charging unit 22 charges the surface of its corresponding photoconductor member 21 to a certain charging potential.

The exposure unit 26 emits exposure lights 261 modulated in accordance with the image data that is input thereto via the controller 10. The photoconductor members 21 that have been charged by the corresponding charging units 22 are irradiated with the exposure lights 261 from the exposure unit 26, so that electrostatic latent images are formed on the surfaces of the corresponding photoconductor members.

After forming the electrostatic latent images on the surfaces of the corresponding photoconductor members 21 by irradiating the surfaces of the photoconductor members 21 with the exposure lights 261, the developing units 23 develop the electrostatic latent images, so that toner images (formed by the toners of the colors corresponding to the image formation engines 20Y, 20M, 20C, and 20K) are formed on the surfaces of the corresponding photoconductor members 21.

Each developing unit 23 includes a case 231 containing therein developer including toner and a carrier, two augers 232 that rotate and stir the developer, and a development roller 233 that transports the developer to a position opposing the corresponding photoconductor member 21 while the development roller 233 rotates. Each development roller 233 corresponds to an exemplary developer transporting member. In developing the electrostatic latent images formed on the photoconductor members 21, bias voltages are applied to the development rollers 233, and the actions of the bias voltages cause the toners in the developers to adhere to the photoconductor members 21 in accordance with the electrostatic latent images formed on the corresponding photoconductor members 21. This causes toner images to be formed. The structure of each developing unit 23 is further described later with reference to FIG. 2.

The toner images formed on the photoconductor members 21 by the development using the developing units 23 are transferred to the intermediate transfer belt 31 by the operations of the transfer units 25.

Any toner remaining on the photoconductor members 21 after the transfer are removed from the photoconductor members 21 by corresponding cleaners 24.

Each cleaner 24 includes a case 241, a cleaning blade 242, and a transporting member 243. Each cleaning blade 242 is an elastic rubber plate member that scrapes off any residual toner on the corresponding photoconductor member 21 by an edge thereof being pushed against the surface of its corresponding photoconductor member 21. Each transporting member 243 is a member that extends in a direction perpendicular to FIG. 1 and that rotates for transporting in a direction perpendicular to FIG. 1 any residual toner that has been scraped off by the cleaning blade 242 and that has fallen into the corresponding case 241. Each transporting member 243 causes the residual toner that has been transported in the case 241 by the corresponding transporting member 243 to pass along a path (described later), and to be finally accommodated in a collecting box (also described later).

The intermediate transfer belt 31 is an endless belt that is placed on rollers 32 and that circulates in the direction of arrow C.

The toner images formed by the corresponding image formation engines 20Y, 20M, 20C, and 20K using the toners of the corresponding colors are successively transferred to the intermediate transfer belt 31 so as to be placed upon each other, and are transported to a second transfer position where a second transfer unit 41 is disposed. In synchronism with this, a sheet that has been transported to the standby rollers 16 is transported to the second transfer position, and the toner images on the intermediate transfer belt 31 are transferred to the transported sheet by the operation of the second transfer unit 41. The sheet to which the toner images have been transferred is further transported. Then, a fixing unit 50 fixes the toner images on the sheet to the sheet by pressure and heat, so that an image formed by the fixed toner images is formed on the sheet. The sheet on which the image has been formed is further transported and is discharged onto the sheet-discharge table 11.

The intermediate transfer belt 31 after the transfer of the toner images to the sheet by the operation of the second transfer unit 41 is further circulated, and a cleaner 42 removes any residual surface on a surface of the intermediate transfer belt 31.

Similarly to the cleaners 23, the cleaner 42 also includes a case 421, a cleaning blade 422, and a transporting member 423. The cleaning blade 422 is pushed against the intermediate transfer belt 31, and scrapes off any residual toner on the intermediate transfer belt 31 into the case 421. The transporting member 423 transports the residual toner scraped off into the case 421 in a direction perpendicular to FIG. 1. The toner that has been transported in the case 421 passes along a path (described later), and is finally accommodated in a collecting box 70 (described later).

Developer containers 43Y, 43M, 43C, and 43K that contain developers including toners of the corresponding colors and carriers are mounted above the intermediate transfer belt 31. The developers contained in the corresponding developer containers 43Y, 43M, 43C, and 43K are supplied to the developing units 23Y, 23M, 23C, and 23K in accordance with developer discharge amounts and toner consumption amounts at the developing units 23Y, 23M, 23C, and 23K provided at the corresponding image formation engines 20Y, 20M, 20C, and 20K.

Figure 2:
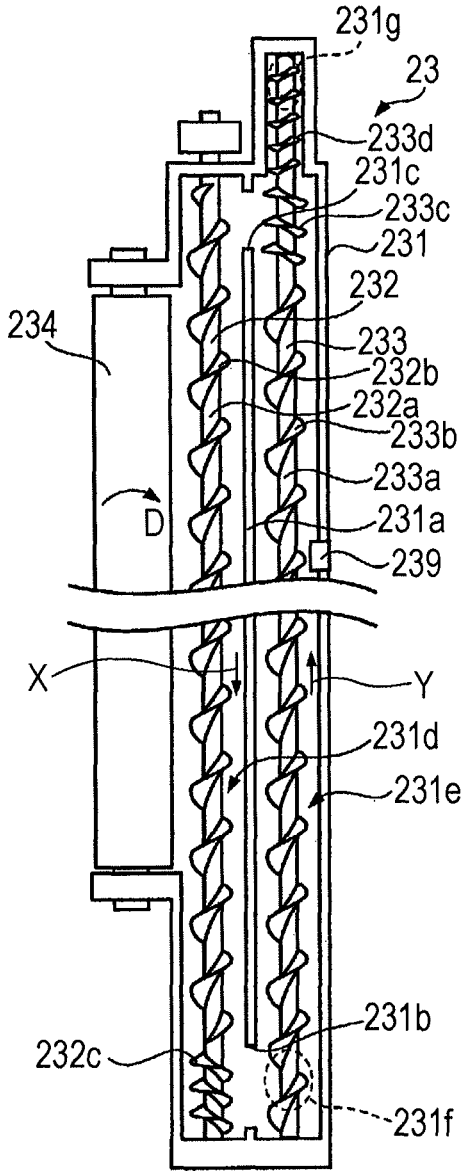
FIG. 2 is a top perspective view of the interior of one of developing units schematically shown in FIG. 1.

FIG. 2 is a top perspective view of the interior of one of the developing units schematically shown in FIG. 1.

Here, the developing units 23 are described without using the letters Y, M, C, and K used for distinguishing between the toner colors.

Each developing unit 23 includes the case 231, the two transporting members 232 and 233 extending parallel to each other, and a development roller 234 that rotates in the direction of arrow D shown in FIG. 1.

In each case 231, a partition wall 231*a* that is provided between the two transporting members 232 and 233 partitions the case 231 into two chambers 231*d* and 231*e*. However, openings 231*b* and 231*c* are formed in corresponding ends of each case 231 in a longitudinal direction thereof.

Each transporting member 232 includes a rotary shaft 232*a* having the form of a round bar and a spiral blade 232*b* that spirals in the direction of extension of the rotary shaft 232*a*. Each transporting member 233 includes a rotary shaft 233*a* having the form of a round bar and a spiral blade 233*b* that spirals in the direction of extension of the rotary shaft 233*a*. The transporting members 232 and 233 rotate so that the transporting member 232 transports the developer in the case 231 in the direction of arrow X and the transporting member 233 transports the developer in the direction of arrow Y. A developer receiving opening 231*f* that receives the developer supplied from the corresponding developer container 43 (see FIG. 1) is provided at a portion of an upper surface, which corresponds to one of the end portions of the transporting member 233, of the corresponding case 231. A developer discharging opening 231*g* that discharges the developer from the corresponding developing unit 23 is provided at a portion of a lower surface, which corresponds to the other end portion of the transporting member 233, of the case 231.

An opening-231*b*-side end portion of each transporting member 232 is provided with a spiral blade 232*c* that spirals in a direction that is opposite to the spiraling direction of the spiral blade 232*b*, the spiral blade 232*b* being formed at a portion other than the opening-231*b*-side end portion. When the transporting member 232 rotates, the developer in the chamber 231*d*, where the transporting member 232 is disposed, is transported in the direction of arrow X. The developer that has been transported in the direction of arrow X is pushed back by the oppositely spiraling spiral blade 232*c*, so that the developer moves to the other chamber 231*e* via the opening 231*b*. The developer that has moved to the other chamber 231*e* merges with developer that has been supplied via the developer receiving opening 231*f*. The rotation of the transporting member 233 that is disposed in the chamber 231*e* causes the developer to be transported this time in the direction of arrow Y.

Each transporting member 233 is provided with an oppositely spiraling spiral blade 233*c* at a position that opposes the other opening 231*c*. Beyond each spiral blade 233*c*, a corresponding spiral blade 233*d* that spirals in the same direction as the main spiral blade 233*b* with a smaller pitch is formed.

When the developer that has been transported in the direction of arrow Y by the rotation of the corresponding transporting member 233 reaches the position of the corresponding opening 231*c*, the developer is pushed back by the oppositely spiraling spiral blade 233*c* disposed at this location, and moves to the chamber 231*d* via the opening 231*c*. In this way, the developer in each case 231 is circulated while being stirred by the two transporting members 232 and 233.

In each case 23, the developer that has been transported in the direction of arrow Y by the transporting member 233 is pushed back by the oppositely spiraling spiral blade 233. However, part of the developer moves beyond the spiral blade 233*d* and is discharged from the developer discharge opening 231*g*. A discharge path beyond the developer discharge opening 231*g* is described later.

In each case 231, the development roller 234 receives the developer from the chamber 231*d*, where the transporting member 232 is disposed, and transports the developer to an area facing the photoconductor member 24 shown in FIG. 1. By the development, the developer whose toner amount is reduced by the development and whose proportion of carrier is increased is returned to the interior of the case 231. The developer whose toner amount is reduced and whose proportion of carrier is increased by the development is, as mentioned above, transported and stirred, mixed with new developer, and transported/stirred.

A TC sensor 239 is disposed at each developing unit 23. Each TC sensor 239 measures toner concentration (TC) of toner with respect to a carrier of the developer that circulates in its corresponding case 231.

Figure 3:
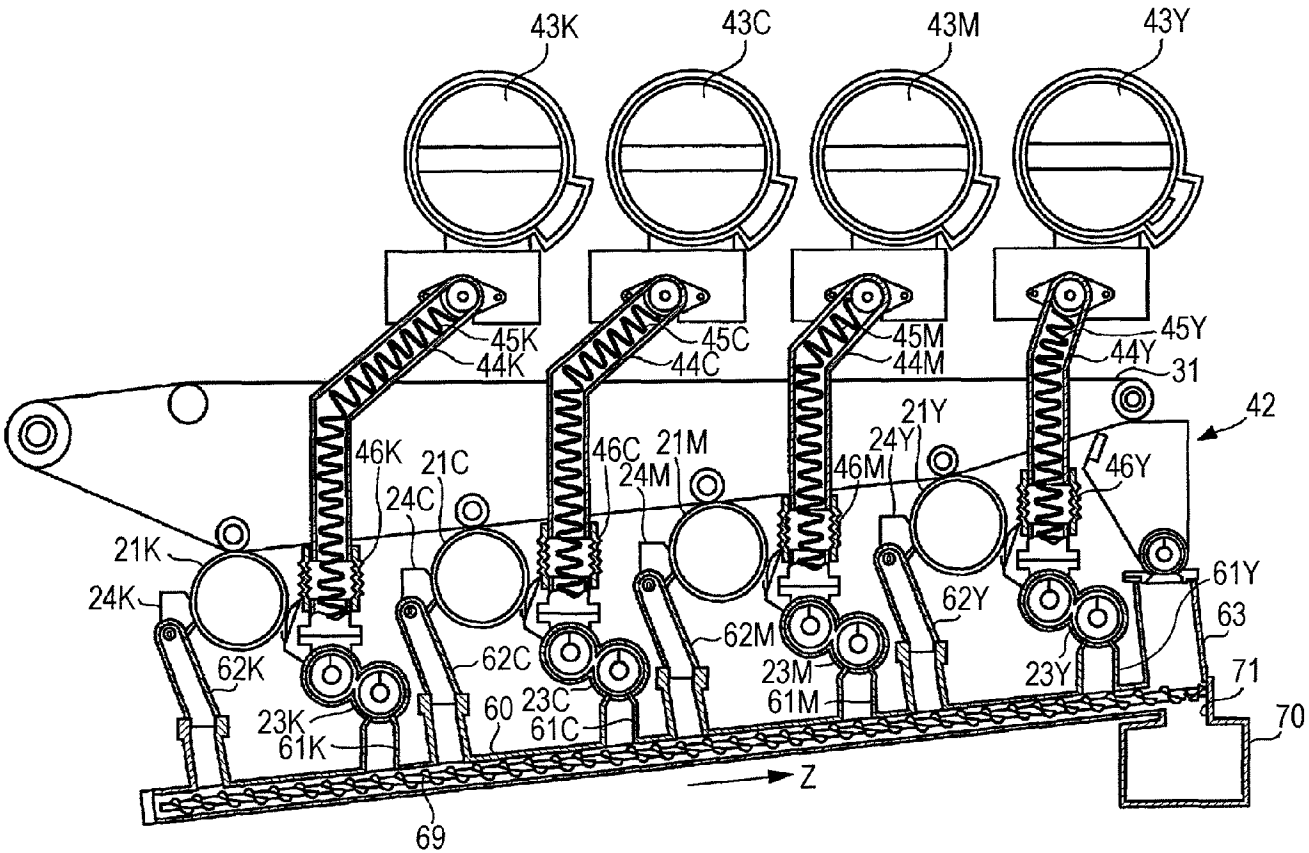
FIG. 3 is a schematic view of a supply path and a discharge path of developer.

FIG. 3 is a schematic view of a supply path and a discharge path of developer. In FIG. 3, members that are not required for describing the supply path and the discharge path are not illustrated as appropriate.

Figure 4:
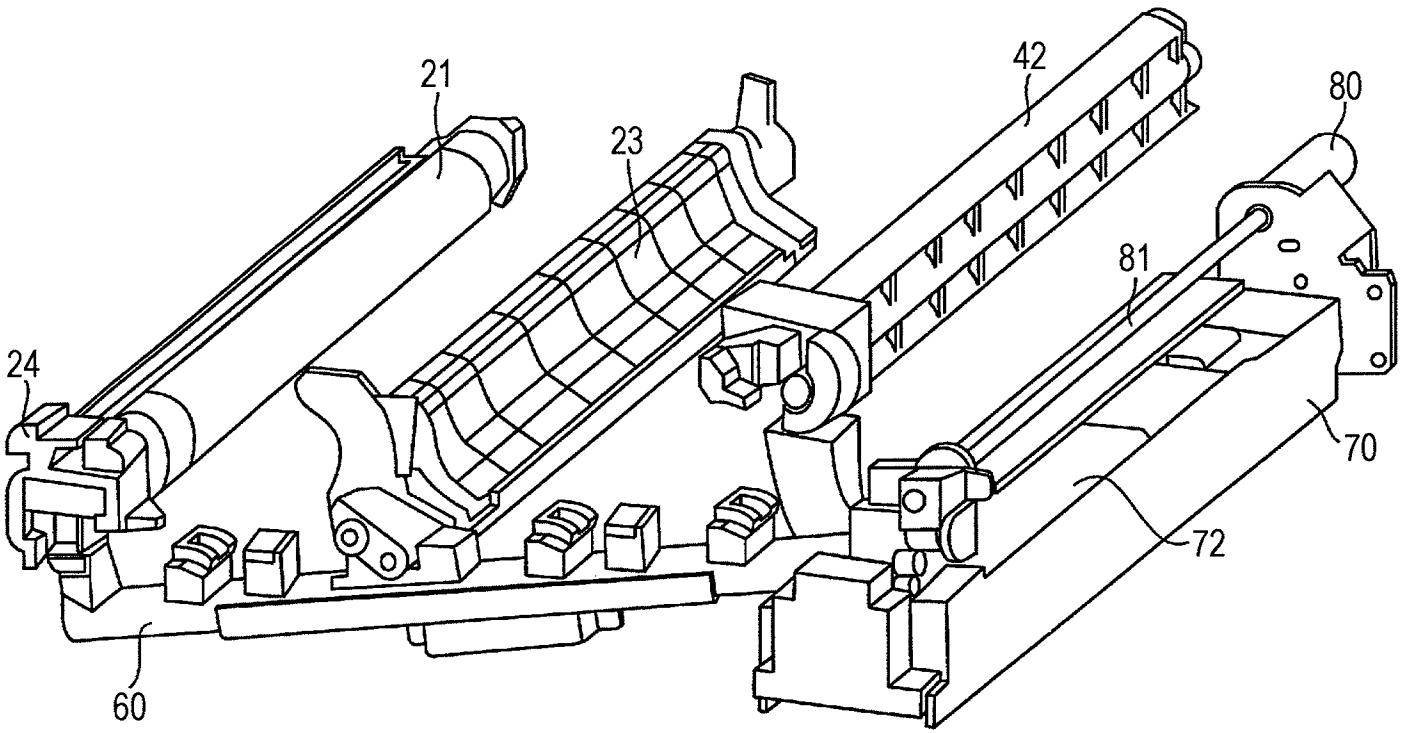
FIG. 4 is an external view of the discharge path of the developer.

FIG. 4 is an external view of the discharge path of the developer. As shown in FIG. 1, the printer 100 includes the four image formation engines, that is, the image formation engines 20Y, 20M, 20C, and 20K. However, in FIG. 4, for simplifying the illustration, only one assembly including the photoconductor member 21 and the cleaner 24 and only one developing unit 23 are shown. FIG. 4 also shows the cleaner 42 that cleans the intermediate transfer belt 31 (see FIG. 1).

Rotation of a transporting member 45, disposed in each developer supply cylinder 44 shown in FIG. 3, causes developer in the developer container 43 to be supplied to the corresponding developing unit 23 via the interior of the corresponding developer supply cylinder 44, and is supplied into the interior of the developing unit 23 from the developer receiving opening 231*f* (see FIG. 2). A lower portion of each developer supply cylinder 44 is connected to the corresponding developing unit 23 by an accordion member 46 for, for example, maintaining and inspecting the corresponding developing unit 23.

Developer that has been discharged from the developer discharge opening 231*g* (see FIG. 2) of each developing unit 23 drops into its corresponding developer drop path 61, and enters a guide cylinder 60 that guides the transport of the developer. Any toner collected by each cleaner 24 that cleans the corresponding photoconductor member 21 drops into a corresponding toner drop path 62, and also enters the guide cylinder 60. The toner collected by the cleaner 42 that cleans the intermediate transfer belt 31 drops into a toner drop path 63. The toner drop path 63 is disposed directly above an opening of the collecting box 70. The toner that has dropped into the toner drop path 63 is, along with developer that has been transported in the interior of the guide cylinder 60 as described below, accommodated in the collecting box 70 via an opening 71.

A transporting member 69 extending in a direction in which developer is guided by the guide cylinder 60 is disposed in the guide cylinder 60. FIG. 4 shows a motor 80. Rotation driving force of the motor 80 is transmitted to the transporting member 69 via a driving shaft 81, and the transporting member 69 is rotated by the transmitted rotation driving force. The developer in the guide cylinder 60 is transported in the direction of arrow Z by the rotation of the transporting member 69, and is collected in the interior of the collecting box 70.

As shown in FIG. 4, a filter 72 is provided in the collecting box 70.

When the transporting member 69 rotates and the developer in the guide cylinder 60 is transported towards the collecting box 70, air in the guide cylinder 60 is, along with the developer, also sent towards the collecting box 70. The filter 72 discharges only the transmitted air to the outside while the developer in the collecting box 70 remains in the collecting box 70.

Hitherto, in general, the transporting member 69 in the guide cylinder 60 is formed so that the transporting member 69 rotates at a certain rotational speed. This is because it has been thought that all that is required is for the transport capability to be sufficient for transporting the developer that has been dropped into the guide cylinder 60.

In the exemplary embodiment, the rotation speed of the transporting member 69 is made variable due to the reasons described below.

Figure 5:
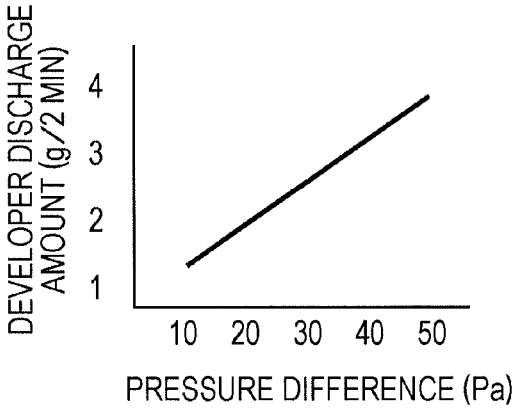
FIG. 5 is a graph showing the relationship between pressure difference and developer discharge amount.

FIG. 5 is a graph showing the relationship between pressure difference and developer discharge amount.

The term "pressure difference" mentioned here refers to pressure difference (Pa) between air pressure in the interior of a developing unit 21 and air pressure in the interior of the corresponding developer drop path 62 that connects the developing unit 21 and the guide cylinder 60 to each other.

Air flows into a developing unit 21 by the rotation of the corresponding development roller 234. The air that has flown into the developing unit 21 is, along with the developer, discharged from the developer discharge opening 231*g* (see FIG. 2), flows into the guide cylinder 60 via the developer drop path 62, is sent towards the collecting box 70 by the rotation of the transporting member 69, and is discharged to the outside via the filter 72 (see FIG. 4), provided in the collecting box 70. Therefore, if the rotational speed of the transporting member 69 is increased, the air flows vigorously, and the air pressure in the developer drop path 62 tends to be lowered.

As shown in FIG. 5, if the pressure difference (Pa) is increased, the amount of developer discharged from a developing unit 23 is increased.

The transporting member 69 in the first place has sufficient developer transport capability. The increase in the developer discharge amount (Pa) caused by the increase in the pressure difference (Pa) is not caused by insufficient transport capability of the transporting member 69. It is caused by the fact that, when the pressure difference (Pa) is large, there is an increase in the amount of developer that is pushed due to the pressure difference, is moved beyond the oppositely spiraling spiral blade 233*c* of the transporting member 233 in the corresponding developing unit 23, and is moved towards the corresponding spiral blade 233*d*.

That is, even if the developer transport capability of the transporting member 69 is, itself, sufficient, it is possible to control the discharge amount of developer from each developing unit 23 by controlling the difference between the air pressure in each developing unit 23 and the air pressure in the developer drop path 62 as a result of adjusting the pressure in the corresponding developer drop path 62 by adjusting the rotation speed of the transporting member 69. Accordingly, in the exemplary embodiment, the rotation speed of the transporting member 69 is controlled in accordance with the conditions that affect the capability of developing an electrostatic latent image on a photoconductor member 21 by the corresponding developing unit 23. This is more specifically described below.

The controller 10 shown in FIG. 1 controls the rotation speed of the transporting member 69. That is, in the exemplary embodiment, the controller 10 corresponds to an exemplary rotation controller.

Figure 6:
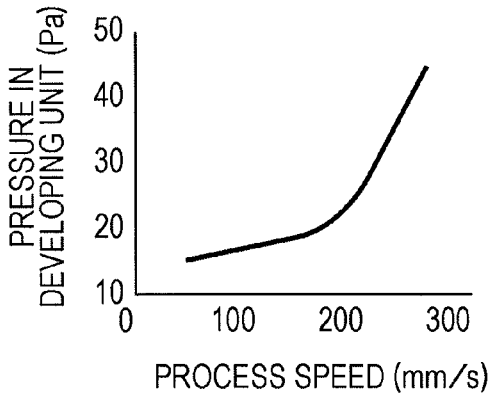
FIG. 6 is a graph showing pressure (Pa) in the interior of a developing unit with respect to process speed (mm/s)

FIG. 6 is a graph showing pressure (Pa) in the interior of a developing unit with respect to process speed (mm/s).

The pressure in the interior of a developing unit 23 increases as the process speed increases. If the process speed (mm/s) increases, the rotation speed of the development roller 234 also increases, so that more air flows into the developing unit 23, thereby increasing the pressure in the interior of the developing unit 23. The increase in pressure is small in a region in which the process speed is low, and tends to increase suddenly as the process speed increases to a value beyond the region in which the process speed is low.

Figure 7:
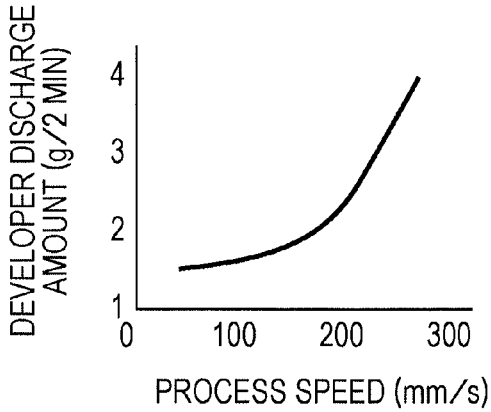
FIG. 7 is a graph showing developer discharge amount (g/2 min) with respect to process speed (mm/s)

FIG. 7 is a graph showing developer discharge amount (g/2 min) with respect to process speed (mm/s). Here, the rotation speed of the transporting member 69 is maintained at a certain value.

FIG. 7 shows that, if the process speed (mm/s) is increased, the developer discharge amount (g/2 min) is increased as indicated by a curve that is similar to the pressure (Pa) change curve shown in FIG. 6.

If the discharge amount of developer in a developing unit 23 is increased, the amount of developer in the developing unit 23 tends to be insufficient. This influences the capability of developing an electrostatic latent image on a photoconductor member 21.

Therefore, in the exemplary embodiment, the rotation speed of the transporting member 69 in the guide cylinder 60 is reduced in accordance with an increase in the process speed, that is, the rotation speed of the development roller 234.

This reduces the pressure difference (Pa) and reduces the developer discharge amount, as a result of which an excessive reduction in the developer in the developing unit 23 is prevented from occurring. It is possible to, in the region in which the process speed is low, maintain the rotation speed of the transporting member 69 at a certain value even if the process speed is changed, and to, only in a region in which the process speed is high, adjust the rotation speed of the transporting member 69.

Figure 8:
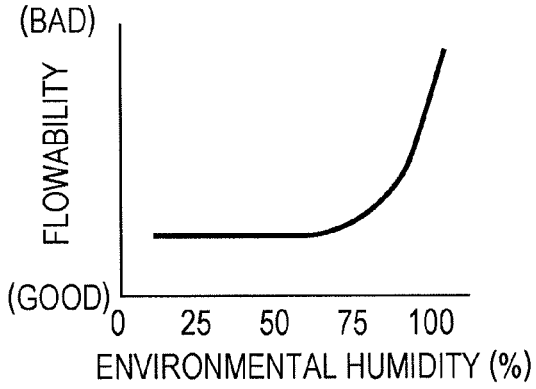
FIG. 8 is a graph showing flowability of developer with respect to environmental humidity (%)

FIG. 8 is a graph showing flowability of developer with respect to environmental humidity (%).

The term "environmental humidity (%)" mentioned here refers to the humidity measured by the temperature-and-humidity sensor 19 that is shown in FIG. 1 and that is provided within the frame 101 of the printer 100.

If the environmental humidity (%) exceeds a value on the order of 75%, the flowability of developer is suddenly deteriorated.

Figure 9:
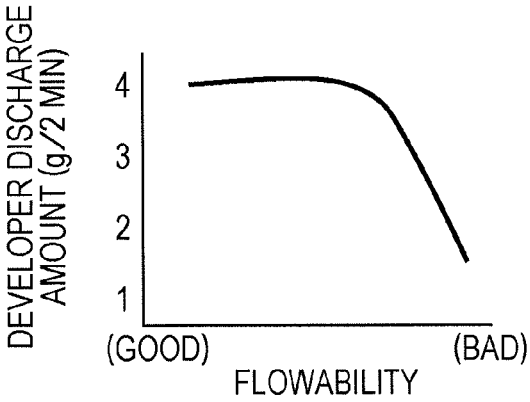
FIG. 9 is a graph showing changes in developer discharge amount with respect to flowability.

FIG. 9 is a graph showing changes in the developer discharge amount with respect to flowability. Even here, as in FIG. 7 illustrating the process speed, the rotation speed of the transporting member 69 is maintained at a certain speed.

FIG. 9 shows that, when the flowability of developer deteriorates, the developer discharge amount is reduced suddenly.

When the flowability of developer deteriorates, the developer tends to be pushed back by the oppositely spiraling spiral blade 233*c* of its corresponding transporting member 233 that is disposed in the developing unit 23 shown in FIG. 2. As a result, the amount of developer that flows beyond the oppositely spiraling spiral blade 233*c* and towards the spiral blade 233*d* is reduced.

Therefore, in the exemplary embodiment, control the increases the rotation speed of the transporting member 69 in accordance with an increase in the environmental humidity is performed. This causes the pressure difference to increase, and the discharge of developer to be accelerated. The flowability of the developer deteriorates when the environmental humidity exceeds 75%. Therefore, the rotation speed of the transporting member 69 may be adjusted only when the humidity exceeds 75%. The environmental humidity is one of the conditions that affect the capability of developing an electrostatic latent image on a photoconductor member 21.

Figure 10:
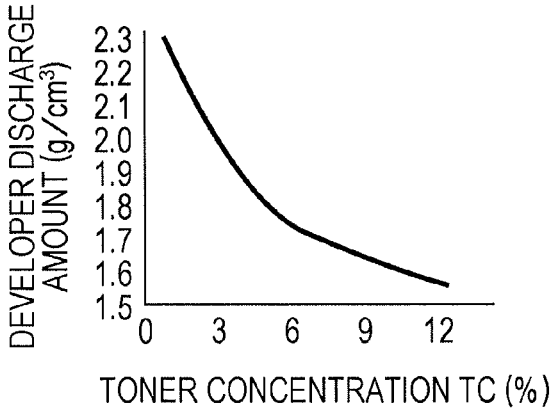
FIG. 10 is a graph showing the relationship between toner concentration TC(%) of developer in a developing unit and density of the developer (g/cm$^3$)

FIG. 10 is a graph showing the relationship between the toner concentration TC(%) of developer in a developing unit and density of the developer (g/cm$^3$). Here, the term "toner concentration TC" refers to the concentration of toner with respect to a carrier of the developer circulating in a developing unit 23. The toner concentration TC is measured with the sensor 239 (see FIG. 2) in the developing unit 23.

The density of toner and the density of a carrier differ from each other. When the toner concentration TC is increased, the density of the developer including the toner and the carrier is reduced. The controller 10 (see FIG. 1) performs control so as to supply the developer from each developer container 43 for restoring the toner concentration TC to its original concentration. However, when the toner concentration is restored to its original concentration, the amount of developer in each developing unit 23 tends to be excessively reduced. Therefore, in the exemplary embodiment, control that reduces the rotation speed of the transporting member 69 in accordance with an increase in the toner concentration TC is performed. The toner concentration TC is one of the conditions that affect the capability of developing an electrostatic latent image on a photoconductor member 21.

Further, the controller 10 of the printer 100 shown in FIG. 1 measures the image density on the basis of image data that has been input. The term "image density" mentioned here refers to the number of pixels per unit area in which toner adheres to an electrostatic latent image formed on a photoconductor member 51 on the basis of the image data when the electrostatic latent image is developed.

When the image density is high, the amount of toner that is used for developing the electrostatic latent image is increased and tends to be insufficient. Therefore, the developer supply amount from the corresponding developer container 43 is increased due to replenishment by the developer container 43 using toner.

The developer that is supplied from each developer container 43 includes not only toner but also a carrier. When the toner amount is restored, the amount of developer in each developing unit tends to increase in correspondence with the flowing in of the carrier.

Therefore, in the exemplary embodiment, control that increases the rotation speed of the transporting member 69 in accordance with the image density, that is, the number of pixels in which toner adheres to an electrostatic latent image is performed.

The image density is also one of the conditions that affect the capability of developing an electrostatic latent image on a photoconductor member 21.

Further, the controller 10 of the printer 100 shown in FIG. 1 measures a past accumulated print volume (PV). The term "print volume (PV)" refers to the accumulated number of prints (images formed) in the printer 100. The print volume (PV) is reset when a developing unit 23 is replaced. The developer in a developing unit 23 is gradually replaced by a supply of new developer while a portion of the developer is discharged at all times. However, when the developer is used for a long time, the developer in the developing unit deteriorates, as a result of which flowability deteriorates. As shown in FIG. 9, when the flowability of developer deteriorates, the developer discharge amount from a developing unit is reduced. Therefore, in the exemplary embodiment, control that increases the rotation speed of the transporting member 69 in accordance with an increase in the print volume (PV) is performed.

The print volume (PV) is also one of the conditions that affect the capability of developing an electrostatic latent image on a photoconductor member 21.

In the foregoing description, the causes of controlling the rotation speed of the transporting member 69 are explained by describing one by one the conditions that affect the capability of developing an electrostatic latent image on a photoconductor member 21. However, the rotation speed of the transporting member 69 is controlled in accordance with a combination of the conditions that affect the capability of developing an electrostatic latent image on a photoconductor member 21.

Figure 11:
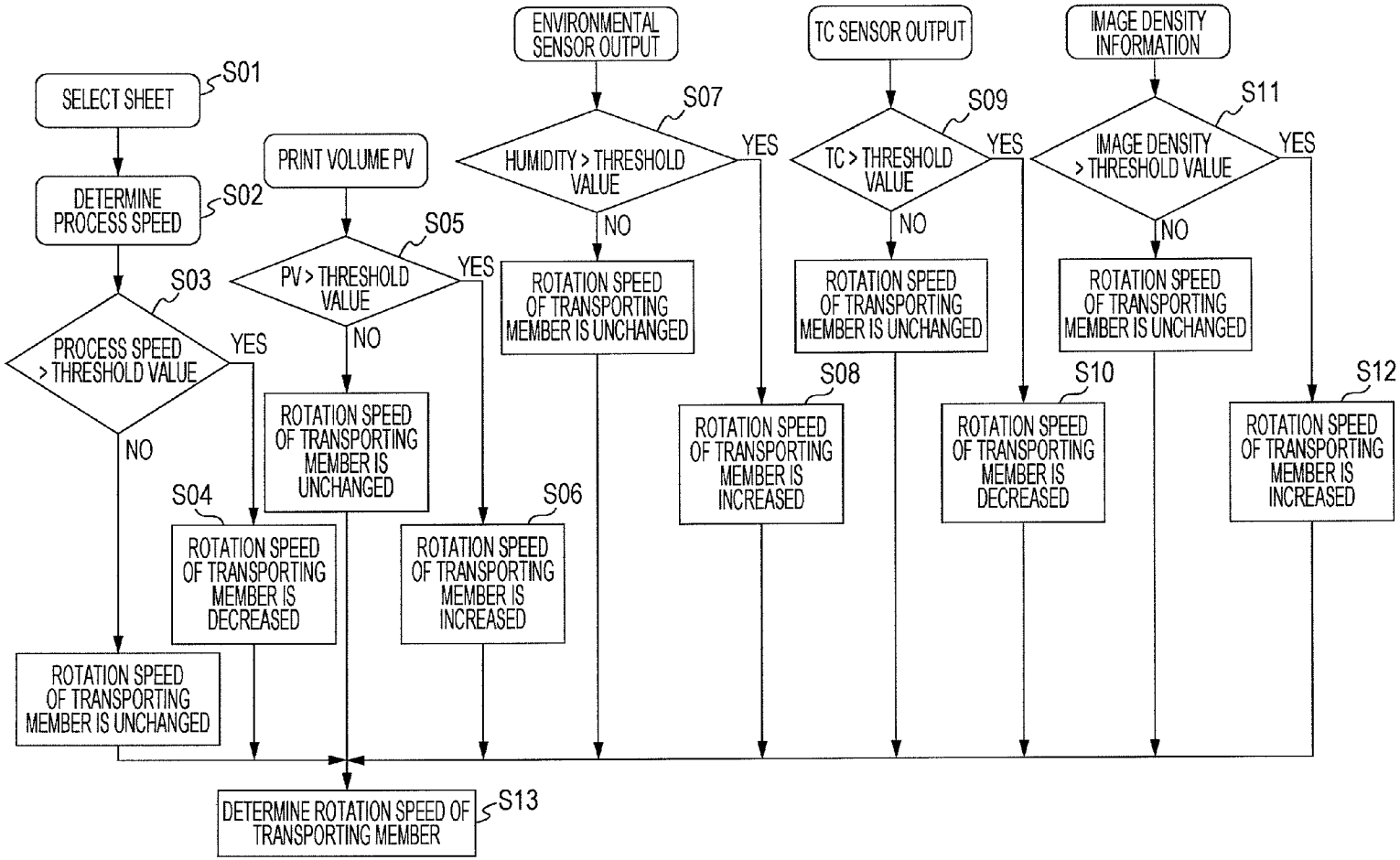
FIG. 11 is a flowchart of control of rotational speed of a transporting member on the basis of a combination of conditions that affect the capability of developing an electrostatic latent image on a photoconductor member.

FIG. 11 is a flowchart of control of rotational speed of the transporting member on the basis of a combination of the conditions that affect the capability of developing an electrostatic latent image on a photoconductor member 21.

In the printer 1 shown in FIG. 1, a user selects a sheet to be used in a print operation (Step S01). Then, in the printer 1, the process speed that is in conformity with the selected sheet is determined (Step S02). Then, a determination is made as to whether or not the determined process speed exceeds a threshold value (Step S03). If it is determined that the process speed exceeds the threshold value, a decrease amount from a standard rotation speed of the rotation speed of the transporting member 69 is determined (Step S04). The decrease amount is determined only on the basis of the process speed.

When the process speed is less than or equal to the threshold value, the rotation speed of the transporting member 69 is kept at the standard rotation speed.

Then, a determination is made as to whether or not the print volume (PV) exceeds a threshold value on the basis of print volume (PV) information (Step S05). If it is determined that the print volume (PV) exceeds the threshold value, an increase amount from the standard speed of the rotation speed of the transporting member 69 is determined (Step S06). The increase amount is determined only on the basis of the print volume (PV).

When the print volume (PV) is less than or equal to the threshold value, the rotation speed of the transporting member 69 is kept at the standard rotation speed.

Then, a determination is made as to whether or not the environmental humidity exceeds a threshold value on the basis of environmental humidity information from the temperature-and-humidity sensor 19 (see FIG. 1) (Step S07). When it is determined that the environmental humidity exceeds the threshold value, the increase amount from the standard speed of the rotation speed of the transporting member 69 is determined (Step S08). The increase amount is determined only on the basis of the environmental humidity.

When the environmental humidity is less than or equal to the threshold value, the rotation speed of the transporting member 69 is kept at the standard rotation speed.

Then, it is determined whether or not the toner concentration TC exceeds a threshold value on the basis of toner concentration TC information from the TC sensor 239 (see FIG. 2) (Step S09). When it is determined that the toner concentration TC exceeds the threshold value, the decrease amount from the standard speed of the rotation speed of the transporting member 69 is determined (Step S10). The decrease amount is determined only on the basis of the toner concentration TC.

When the toner concentration TC is less than or equal to the threshold value, the rotation speed of the transporting member 69 is kept at the standard speed.

Further, a determination is made as to whether or not the image density exceeds a threshold value on the basis of image density information (Step S11). When it is determined that the image density exceeds the threshold value, the increase amount from the standard speed of the rotation speed of the transporting member 69 is determined (Step S12). The increase amount is determined only on the basis of the image density.

When the image density is less than or equal to the threshold value, the rotation speed of the transporting member 69 is kept at the standard rotation speed.

The threshold values used in the determinations in Steps S03, S05, S07, S09, and S11 are separately determined threshold values, and are not necessarily the same.

In Step S13, the increase amounts and the decrease amounts of the rotation speed of the transporting member 69, which have been determined for the corresponding conditions, are generalized, and the rotation speed of the transporting member 69 is determined. The controller 10 (see FIG. 1) performs control so that the rotation speed of the transporting member 69 becomes the rotation speed determined in Step S13.

Here, the decrease amount of the rotation speed of the transporting member 69 is determined on the basis of, for example, whether or not the process speed exceeds the threshold value. However, it is possible to determine the decrease amount of the rotation speed by considering the number of prints or the time in which a process speed exceeding the threshold value continues without immediately reducing the rotation speed of the transporting member 69 even if the process speed exceeds the threshold value. This also applies to the conditions other than the process speed.

Here, an exemplary embodiment in which the present invention is applied to the printer shown in FIG. 1 is described. However, the present invention is not limited in its application to only the printer shown in FIG. 1. The present invention is applicable to any device as long as it is a device including a developing unit that gradually discharges developer including toner and a carrier and to which new developer is supplied.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer collecting device comprising:

a collecting box that accommodates developer discharged from a developing unit so that the developer accommodated in the collecting box does not return to the developing unit, the developing unit accommodating developer including toner and a carrier, the developing unit developing an electrostatic latent image on a development member using the toner in the developer, wherein the developing unit includes a developer transporting member that, while rotating, carries on a surface thereof the developer that is accommodated in the developing unit and transports the developer to a location opposing the development member;

a guide cylinder that connects the developing unit and the collecting box to each other, the guide cylinder guiding movement of the developer discharged from the developing unit to the collecting box;

a transporting member that is disposed in the guide cylinder, that extends in a developer transport direction, and that transports the developer towards the collecting box by rotation of the transporting member; and a rotation controller that controls rotation speed of the transporting member in accordance with conditions that affect a capability of developing the electrostatic latent image on the development member, wherein the rotation controller performs control that reduces the rotation speed of the transporting member in accordance with an increase in rotation speed of the developer transporting member.

2. The developer collecting device according to claim 1, further comprising a sensor that measures environmental humidity, wherein the rotation controller performs control that increases the rotation speed of the transporting member in accordance with an increase in the environmental humidity.

3. The developing collecting device according to claim 1, further comprising a sensor that measures a concentration of the toner with respect to the carrier in the developer that is accommodated in the developing unit, wherein the rotation controller performs control that reduces the rotation speed of the transporting member in accordance with an increase in the concentration of the toner.

4. The developer collecting device according to claim 1, further comprising a measuring unit that measures the number of pixels in which the toner adheres to the electrostatic latent image on the development member when developing the electrostatic latent image using the developing unit, wherein the rotation controller performs control that increases the rotation speed of the transporting member in accordance with an increase in the number of pixels in which the toner adheres to the electrostatic latent image.

5. The developer collecting device according to claim 4, further comprising a calculating unit that calculates an accumulated time of use of the developing unit, wherein the rotation controller performs control that increases the rotation speed of the transporting member in accordance with an increase in the accumulated time of use.

6. An image forming apparatus comprising:

an image carrying member on which a toner image is formed by developing an electrostatic latent image that is formed on the image carrying member in accordance with image information;

a developing unit that accommodates developer including toner and a carrier, the developing unit discharging a portion of the developer while the developing unit circulates the accommodated developer, being supplied with new developer, and developing the electrostatic latent image on the image carrying member using the toner in the developer, wherein the developing unit includes a developer transporting member that, while rotating, carries on a surface thereof the developer that is accommodated in the developing unit and transports the developer to a location opposing the image carrying member;

a transfer unit that transfers the toner image on the image carrying member to a sheet;

a fixing unit that fixes the toner image transferred to the sheet to the sheet; and a developer collecting device that collects the developer discharged from the developing unit, wherein the developing collecting device includes a collecting box that accommodates the developer discharged from the developing unit so that the developer accommodated in the collecting box does not return to the developing unit, a guide cylinder that connects the developing unit and the collecting box to each other, the guide cylinder guiding movement of the developer discharged from the developing unit to the collecting box, a transporting member that is disposed in the guide cylinder, that extends in a developer transport direction, and that transports the developer towards the collecting box by rotation of the transporting member, and a rotation controller that controls rotation speed of the transporting member in accordance with conditions that affect a capability of developing the electrostatic latent image on the image carrying member, wherein the rotation controller performs control that reduces the rotation speed of the transporting member in accordance with an increase in rotation speed of the developer transporting member.

7. A developer collecting device comprising:

a collecting box that accommodates developer discharged from a developing unit, the developing unit accommodating developer including toner and a carrier, the developing unit developing an electrostatic latent image on a development member using the toner in the developer;

a guide cylinder that connects the developing unit and the collecting box to each other, the guide cylinder guiding movement of the developer discharged from the developing unit to the collecting box;

a transporting member that is disposed in the guide cylinder, that extends in a developer transport direction, and that transports the developer towards the collecting box by rotation of the transporting member;

a rotation controller that controls rotation speed of the transporting member in accordance with conditions that affect a capability of developing the electrostatic latent image on the development member; and a sensor that measures a concentration of the toner with respect to the carrier in the developer that is accommodated in the developing unit, wherein the rotation controller performs control that reduces the rotation speed of the transporting member in accordance with an increase in the concentration of the toner.

8. A developer collecting device comprising:

a collecting box that accommodates developer discharged from a developing unit, the developing unit accommodating developer including toner and a carrier, the developing unit developing an electrostatic latent image on a development member using the toner in the developer;

a guide cylinder that connects the developing unit and the collecting box to each other, the guide cylinder guiding movement of the developer discharged from the developing unit to the collecting box;

a transporting member that is disposed in the guide cylinder, that extends in a developer transport direction, and that transports the developer towards the collecting box by rotation of the transporting member;

a rotation controller that controls rotation speed of the transporting member in accordance with conditions that affect a capability of developing the electrostatic latent image on the development member;

a measuring unit that measures the number of pixels in which the toner adheres to the electrostatic latent image on the development member when developing the electrostatic latent image using the developing unit; and a calculating unit that calculates an accumulated time of use of the developing unit, wherein the rotation controller performs control that increases the rotation speed of the transporting member in accordance with (i) an increase in the number of pixels in which the toner adheres to the electrostatic latent image and (ii) an increase in the accumulated time of use.

* * * * *